United States Patent [19]

Wood et al.

[11] 4,264,418

[45] Apr. 28, 1981

[54] METHOD FOR DETERSIFYING AND OXIDE COATING REMOVAL

[75] Inventors: William G. Wood, Grosse Pointe Farms; John F. Pilznienski, Dearborn Heights; James C. Malloy, Canton Township, Wayne County, all of Mich.

[73] Assignee: Kilene Corp., Detroit, Mich.

[21] Appl. No.: 943,674

[22] Filed: Sep. 19, 1978

[51] Int. Cl.[3] ..... C25F 3/06; C25F 3/24

[52] U.S. Cl. ..... 204/129.95; 134/3; 134/41; 156/664; 156/666; 204/141.5; 204/145 R; 252/79.1

[58] Field of Search ..... 156/664, 667, 666; 252/79.1, 80, 82, 100, 142; 134/3, 40, 41; 204/129.75, 141.5, 145 R, 129.85, 129.95

[56] References Cited

U.S. PATENT DOCUMENTS

| | | | |
|---|---|---|---|
| 1,598,731 | 9/1926 | Lee | 204/145 R |
| 1,863,868 | 6/1932 | McCullough | 204/129.95 |
| 3,003,898 | 10/1961 | Reich | 252/82 |
| 3,054,737 | 9/1962 | Salt | 204/129.95 |
| 3,072,502 | 1/1963 | Alfano | 134/3 |
| 3,129,153 | 4/1964 | Margulies et al. | 204/129.75 |
| 3,162,547 | 12/1964 | Kendall | 134/3 |
| 3,166,444 | 1/1965 | Ehren | 252/79.1 |
| 3,211,659 | 10/1965 | Pikaar | 252/100 |
| 3,218,260 | 11/1965 | Lewandowski | 252/142 |
| 3,454,501 | 7/1969 | Ziffer et al. | 252/142 |
| 3,696,044 | 10/1972 | Rutledge | 134/3 |
| 3,806,366 | 4/1974 | Cofer et al. | 134/3 |
| 3,853,618 | 12/1974 | Smith | 134/3 |
| 3,915,633 | 10/1975 | Ramachandran | 252/142 |
| 4,162,172 | 7/1979 | Longo | 134/3 |

*Primary Examiner*—Jerome W. Massie
*Attorney, Agent, or Firm*—William N. Hogg

[57] ABSTRACT

A method and composition is disclosed for removing oxide film from metals and alloys and for detersification of objects. The composition is at least a 1% aqueous solution of gluconic acid or its alkali metal including ammonium salts, citric acid or its alkali metal including ammonium salts, and tartaric acid or its alkali metal including ammonium salts, at least one of these materials being acid in sufficient strength to provide a pH of 4 or less. Also, preferably a non-ionic surfactant is included.

7 Claims, No Drawings

METHOD FOR DETERSIFYING AND OXIDE COATING REMOVAL

BACKGROUND OF THE INVENTION

This invention relates generally to a composition and method for detersifying and/or removing oxide film or scale from a wide variety of metal alloys, and more particularly to a composition and method for such detersification and/or oxide removal which is relatively mild, non-toxic, has safe disposal products, and which will not attack the base metal, but which will be effective in a reasonable amount of time.

There have been many prior art proposals for agents for detersifying metal surfaces, and also, many proposals for agents for removing oxide films and scales. These have taken many forms. Detersive agents generally have a caustic alkaline type base. Oxide removal agents include strong mineral acids, or mixture of such acids such as $H_2SO_4$, HCl, $HNO_3$ /HF, etc. Also, fused alkaline oxidizing salts are commonly used, as well as certain strong aqueous solution of salts with electolysis, such as $Na_2SO_4$, etc. All of these have certain applications in which they function satisfactorily and indeed function quite well in many instances. However, they do have certain draw-backs in many situations. For example the caustics for detersive action are harsh, and skin and eye contact must be avoided, and thus great care must be exercised in their use. The toxicity, and other undesirable properties, such as disposal problems of mineral acids, are well known. Fused salts of course are toxic, require energy to maintain the bath fused, and also pose disposal problems. Electrolytic aqueous baths also require energy to operate and also usually are toxic, and have somewhat narrow ranges of use.

SUMMARY OF THE INVENTION

According to the present invention, an improved composition and method of detersifying a wide variety of metal surfaces and/or removing oxide film and scale therefrom is provided. The composition includes gluconic acid or its alkali metal including ammonium salts, tartaric acid or its alkali metal including ammonium salts, citric acid or its alkali metal including ammonium salts. At least one of the materials must be acid in sufficient strength to provide a pH of 4 or less. A surfactant is required if the composition is to be used as a detersive agent, but is preferred in any event. Preferably, the composition includes about 30 to 60% sodium gluconate, about 30 to 60% citric acid, about 1 to 25% tartaric acid, and about 0.01 to 5% of a non-ionic surfactant, in an aqueous solution, preferably at least a 1% solution. The solution preferably is used at elevated temperatures of about 150° F., for detersifying the surface of any metal or of removal of oxide film from metals containing Fe, Ni, Cu, Be, Cr, Au, Zn, Pb and Sn. The solution may be used electrolytically for scale removal.

DESCRIPTION OF THE PREFERRED EMBODIMENT(S)

According to the present invention an aqueous solution of gluconic acid or its alkali metal including ammonium salts, citric acid or its alkali metal including ammonium salts, and tartaric acid or its alkali metal including ammonium salts and preferably a non-ionic, surfactant, with at least one of the materials being present in acid form in sufficient quantity to provide a pH of 4 or less is utilized to detersify the surface of metals generally and/or remove their oxide film from metals or alloys containing Fe, Ni, Cu, Be, Cr, Au, Zn, Pb, or Sn. As used herein alkali metal is intended to include ammonium, although strictly speaking it is not necessarily included. There should be at least a 1% solution by weight, and preferably a 10% solution; although, the solution strength can be up to saturation which is about a 35% solution by weight. At least one of the materials must be present in acid form in sufficient quantity to provide a pH of 4 or less. The relationship between the gluconate, citrate, tartrate and surfactant should be about 30% to 60% by weight gluconate about 30% to 60% by weight citrate, about 1% to 25% by weight tartrate, and about 0.01% to 5% by weight surfactant. Within these broad ranges, a very satisfactory solution is provided. It is especially desirable to provide the material in a dry mix form, and in such cases it is desirable to use sodium gluconate, citric acid, and tartaric acid, all of which are available in a dry powdered form. These materials can be mixed to form the desired composition with the non-ionic surfactant and the resultant composition which can be dissolved in water for use for detersifying and oxide removal from metals.

An especially useful composition is one of about 47.5% citric acid, about 47.5% sodium gluconate, about 4.9% tartaric acid, and about 0.1% non-ionic surfactant. Such a composition in a 10% by weight aqueous solution is very effective as both a detersive agent for removing grease and oil from the surface metals and also as an agent for removing light oxide film from certain metals and alloys. Indeed, in a comparison of this composition with $H_2SO_4$ in treating a beryllium-copper material with inlaid gold, this material performed better than the mineral acid $H_2SO_4$. Similar strips of beryllium-copper with gold inlays and which had light oxide films thereon were each immersed, one in a 10% solution of the above material, and one in a 20% $H_2SO_4$ solution bath, each bath maintained at 150° F. And each strip left in the solution for 10 minutes. The $H_2SO_4$ did not evenly remove the light oxide film from the beryllium-copper, nor did it appreciably remove any oxide film from the gold. Also, the $H_2SO_4$ attacked the copper metal actually etching the metal and removing base material in a very uneven pattern. The solution of this invention, on the other hand, removed the oxide uniformly from the beryllium-copper without any noticeable attack on the base metal. Also, there was oxide film removed from the gold by the solution of this invention. Thus, this solution performed better on this beryllium-copper and gold than conventional $H_2SO_4$ pickle. In addition, this solution is non-toxic and non-corrosive, and presents no waste disposal problems as compared to $H_2SO_4$.

Other tests performed on stainless steel with the above solution of this invention showed a good removal of thin oxide film leaving a bright substrate. Also, solder and bronze material when treated in this solution of this invention showed good oxide removal without detrimental attack on the substrate metal.

Stainless steel, having moderate oil and grease, when treated in a 10% solution of the above components for just a few minutes at 150° F. showed a very complete removal of the grease and oil, which thus provides a very good pre-conditioning treatment for a metal prior to subsequent operations such as bright annealing.

Also, when a material, such as stainless steel, copper alloys, or the like has a heavy oxide scale, the solution of this invention can be used with electric current to descale the metal. The current should be as high as the conductivity of the solution allows, and periodic reversal of polarity every few seconds is desirable.

The mechanism of the action of the solution is not completely understood, and it is especially surprising that the composition works so well both as a detersive agent and as an agent for removing oxide films. It is theorized that citric acid is effective in attacking and dissolving the oxides that are on the surface of the metals, especially the Cu, Fe, Cr and Ni and chelates all of these removed oxides in the solution, at an acid level of a pH of about 4 or less. However above this pH value its chelating ability is seriously impaired. The tartaric acid is somewhat stronger than citric acid, and will attack metal oxides vigorously without attack of the metal. Also, it will chelate both ferrous and ferric oxides as well as the difficult $Fe_3O_4$; also tartrate chelates Zn, Be, Cr, Ni and Cu. This is an effective acid to keep the pH low.

Sodium gluconate is especially effective in chelating both ferrous and ferric ions in acid, and also is a chelate at higher pH's, especially in the range of 4–7. It is not known whether it is acting itself as a chelate for all the various Fe, Cu, Cr, Ni, Be, etc., metals, or whether it also enhances the chelating ability of the citric and tartaric acids at these higher pH's of 4–7. In any event, during use, the pH of the solution gradually rises into the 4–7 range and surprisingly the solution remains effective in oxide removal and cleaning even in these higher ranges. It should also be noted that elevated temperatures decrease the necessary time for use, and a temperature of about 150° F. has been found to be very satisfactory. However, higher or lower temperatures can be used, with longer time being required at lower temperatures.

With respect to time of treatment, it has been found that a time of about 10 minutes in a 10% solution of the preferred composition at 150° F. works well on moderately oxidized beryllium-copper alloy with gold inlays. Also, the same time works well on stainless steel with a light oxide coating. Additionally, just a few minutes at 150° F. in the above preferred 10% solution will effectively degrease metal surface having moderate oil and grease residue thereon. With this combination of properties, it is possible for a single solution to act on a metal, such as stainless steel, which has an oily surface on top of light oxide film, thus obviating the necessity of using two separate treatments, one for detersifying and one for oxide removal.

What is claimed is:

1. A method of removing oxide films from a metal or alloy containing Fe, Ni, Cu, Be, Cr, Au, Zn, Pb or Sn consisting of immersing said metal or alloy in an at least 1% by weight aqueous solution of a composition consisting essentially of gluconic acid or its alkali metal including ammonium salts, tartaric acid or its alkali metal including ammonium salts, and citric acid or its alkali metal including ammonium salts, at least one of the materials being in acid form in sufficient quantity to provide a pH of about 4 or less.

2. The invention as defined in claim 1 wherein there is about 30% to about 60% gluconic, about 30% to 60% citric, and about 1% to 25% tartaric by weight.

3. The invention as defined in claim 1 wherein the composition includes an effective amount up to about 5% of a non-ionic surfactant.

4. The invention as defined in claim 2 wherein the materials are sodium gluconate, citric acid, and tartaric acid.

5. The invention as defined in claim 3 wherein there is about 47.5% sodium gluconate, about 47.5% citric acid, about 4.9% tartaric acid, and about 0.1% surfactant.

6. The invention as defined in claim 3 wherein the solution is about a 10% solution by weight.

7. The invention as defined in claim 2 wherein an electric current is passed through said solution.

* * * * *